US005165812A

United States Patent [19]

Lutters

[11] Patent Number: 5,165,812

[45] Date of Patent: Nov. 24, 1992

[54] LEAD WRITING INSTRUMENT WITH SELECTIVE LOCKING OF CHUCK

[75] Inventor: Andreas Lutters, Nuremberg, Fed. Rep. of Germany

[73] Assignee: A. W. Faber-Castell GmbH & Co., Stein, Fed. Rep. of Germany

[21] Appl. No.: 749,696

[22] Filed: Aug. 26, 1991

[30] Foreign Application Priority Data

Oct. 29, 1990 [DE] Fed. Rep. of Germany ..... 4034363

[51] Int. Cl.[5] ..... B43K 21/00; B43K 21/22

[52] U.S. Cl. ..... 401/65; 401/54; 401/94

[58] Field of Search ..... 401/54, 65, 94

[56] References Cited

U.S. PATENT DOCUMENTS

| | | | |
|---|---|---|---|
| 1,780,405 | 11/1930 | Sharrow | 401/54 |
| 2,055,316 | 9/1936 | Sharrow | 401/54 |
| 2,162,914 | 6/1939 | Feather | 401/54 |
| 3,713,745 | 1/1973 | Horie | 401/94 |
| 3,947,133 | 3/1976 | Kageyama et al. | 401/94 X |
| 4,171,170 | 10/1979 | Kageyama et al. | 401/54 X |
| 4,269,524 | 5/1981 | Hashimoto et al. | 401/65 |
| 4,884,911 | 12/1989 | Oikawa | 401/65 |

FOREIGN PATENT DOCUMENTS

| | | | |
|---|---|---|---|
| 648518 | 3/1985 | Switzerland | 401/65 |

*Primary Examiner*—Steven A. Bratlie
*Attorney, Agent, or Firm*—Michael J. Striker

[57] ABSTRACT

A refill lead writing instrument for stepped advancement of a lead has a spring biased clamping device for holding a lead in direction of its longitudinal axis against a writing pressure. The clamping device includes a clamping chuck supported in a clamping sleeve under a spring action and a longitudinally displaceable lead pipe against which the clamping chuck can abut. A gripping part is form-lockingly connected with a shaft so that the shaft and the gripping part are rotatable relative to one another about a common longitudinal axis. The shaft and the gripping part have opening of same diameters and provided with grooves. A longitudinally displaceable supporting pipe has strips guiding in the grooves, one of the grooves having an extension extending in direction of the writing pipe and formed as a recess in which one of the strips is turnable.

8 Claims, 1 Drawing Sheet

LEAD WRITING INSTRUMENT WITH SELECTIVE LOCKING OF CHUCK

BACKGROUND OF THE INVENTION

The present invention relates to a refill lead writing instruments.

Writing instruments of the above mentioned general type are known in the art. In order to prevent breakage of a solid lead which is advanced from the writing pipe of a refill lead writing instrument or pencil, it is known to spring bias the clamping device. As a result, in the event of an excessively high writing force, the lead is moved back into the writing pipe and cannot be broken. For this purpose the spring force which acts on the clamping device is determined with respect to a continuous writing force and the strength of the lead. Because of this the applied writing force cannot exceed a predetermined value.

Refill lead instruments with spring biased clamping devices are known in many modifications. One modification in which the spring biasing of the clamping device is obtained by a pressure spring supported against the lead pipe is disclosed in the German document DD 43,171. A second pressure spring in this construction takes care of the closing of the clamping device which is composed of a conical clamping head arranged in a cylindrical clamping sleeve. A similar construction is disclosed in the German document DE-PS 3,910,546 which has a simple design and is easily mountable.

The German document DE-GM 8,903,990 discloses a writing instrument in which there is a single pressure spring which performs both the functions of the spring biasing of the lead against the writing pressure and the closing of the clamping chuck. All these writing instruments have the common feature that the lead projecting out of the writing pipe during exceeding of a predetermined abutment force is moved back to its position in the writing pipe until it is flush with its front end. In some cases it is however desired by the user to apply an especially high writing force to provide an especially intensive color by the lead. With a substantially vertical holding of the writing instrument this is also possible without breaking the lead. During working with the ruler, this is often desired and with a certain experience also lines with a high writing pressure can be applied.

SUMMARY OF THE INVENTION

Accordingly, it is an object of the present invention to provide a refill lead writing instrument in which it is possible to spring-bias the lead against the housing and when desired to provide a rigid connection of the refill relative to the housing.

It is also an object of the present invention to provide such a writing instrument of this type in which the switching devices required for the above have a simple design and are easily mountable as well as are easily recognizable and can be engaged in a convenient manner.

In keeping with these objects and with others which will become apparent hereinafter, one feature of the present invention resides, briefly stated, in a refill lead writing instrument in which the shaft and the gripping part are rotatably connected with one another in a form-locking manner so as to rotate about a common longitudinal axis, they have openings of the same diameter with grooves which provide guidance for strips arranged on a longitudinally displaceable supporting pipe, and a recess is formed in the extension of the groove in direction of the writing pipe so that the strip can be turned into the recess.

When the writing instrument is designed in accordance with the present invention, it eliminates the disadvantages of the prior art and provides for the above mentioned highly advantageous results.

Due to the arrangement of the longitudinally displaceable supporting pipe, an exact rotatable support of the shaft relative to the gripping part is obtained. By technically simple features, the grooves and a recess can be produced in a simple manner and provide a stable abutment which supports the movement of the clamping device and thereby the writing pressure.

It is advantageous when the supporting pipe is supported on the lead pipe rotatably and longitudinally displaceably. Thereby under the action of a supporting spring, on the one hand abutment against the lead pipe and on the other hand abutment against the supporting pipe is provided so that a play compensation of these parts together with the guiding bush which supports the clamping device is obtained.

An automatic mounting is facilitated when the strips on the outer surface of the supporting pipe have the same length and the same cross-section. Thereby it does not matter in which way the supporting pipe is supplied to the mounting station.

During injection molding it is advantageous when the recess is formed as an extension of the groove in the gripping part and has at least double width as the groove.

The gripping part can be turned so that an end side of the strip completely abuts against the abutment formed in the gripping part.

It is not desirable when during the pressing of the projecting lead and springing back of the total clamping mechanism the rearwardly protruding push button also is visibly displaced. This is eliminated when in accordance with the present invention a distance between the clamping chuck and the lead pipe is such that it is approximately equal or greater than the displacement stroke formed by the distance of the clamping sleeve from the front abutment in the tip.

An especially stable coupling of the gripping part on the shaft is obtained when several arresting fingers are provided and can be elastically spring biased in the radial groove on the shaft.

The stroke for springing-in of the arresting fingers is not limited since both the supporting pipe as well as the lead pipe are inserted after the coupling of the gripping part on the shaft.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

10

DESCRIPTION OF THE PREFERRED EMBODIMENTS

Figures 1, 2, 3, 4, 5:
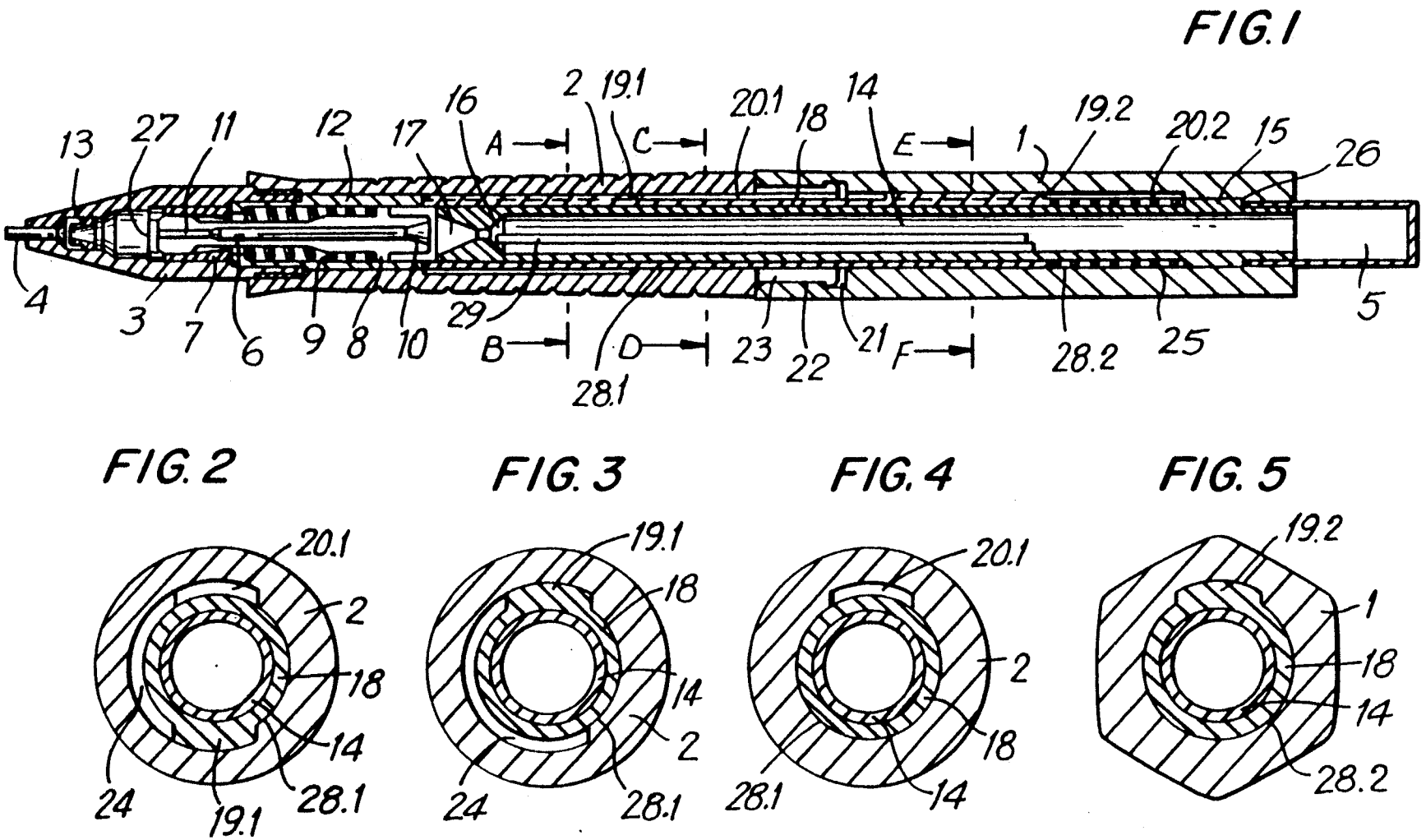
FIG. 1 is a longitudinal section through a refill lead writing instrument in accordance with the present invention in an initial position.
FIG. 2 is a view showing a section taken along the line A-B through a gripping part of the inventive writing instrument with a turned-in abutment.
FIG. 3 is a view substantially corresponding to the view of FIG. 2, however with the turned-out abutment.
FIG. 4 is a view showing a section taken along the line C-D through the gripping part.
FIG. 5 is a view showing a section through a shaft of the inventive writing instrument, taken along the line E-F.

A writing instrument shown in FIG. 1 in longitudinal section has a shaft 1 and a gripping part 2 which is connected with the shaft 1 by several arresting fingers 23 insertable into a blind hole 22 and snapping in a radial groove 21. The parts 1 and 2 are rotatable relative to one another. A tip 3 is screwed in the gripping part 2 and has a fixedly pressed-in writing pipe 4. A push button 5 extends from the rear end of the shaft 1 and serves for actuating a clamping device. The clamping device includes a clamping chuck 6 which abuts in a known manner in a clamping sleeve 7 under the action of a clamping spring 9.

The clamping chuck 6 is supported in a guiding bush 12, while the clamping spring 9 is supported in the guiding bush 12 and on a supporting collar 8 of the clamping chuck 6. The clamping chuck 6 has a clamping opening 11 in its front region. The opening 11 merges rearwardly into a guiding opening 10. The tip 3 carries a lead brake 13 and is provided with an abutment 27 which limits the stroke of the clamping sleeve 7. A lead pipe 14 is supported in the shaft 1 and has an abutment ring 15 abutting against a shoulder 26. In the front region facing the writing pipe 4, an abutment cone 17 is formed on the lead pipe 14. An inlet funnel 16 is located opposite to the abutment cone 17 and operates for supplying the leads 29 to the clamping device.

The lead pipe 14 serves additionally for guiding a supporting pipe 18 which is provided with strips 19.1 and 19.2 on its periphery at a longitudinal distance from one another. The strips are arranged at the end of the supporting pipe and have equal lengths and equal widths. The front strip 19.1 in the position shown in FIG. 1 is located inside a recess 24 of the gripping part, while the strip 19.2 arranged at the side of the push button is guided in a groove 20.2 in the shaft 1. Finally, a groove 20.1 extends on the recess 24 in the gripping part 2 and has a cross-section corresponding to the cross-section of the strip 19.1.

A supporting spring 25 is arranged between the supporting pipe 18 and the abutment ring 15 on the lead pipe 14 with slight pretensioning. The supporting spring 25 compensates the play between the parts inserted between the abutment ring 15 and the tip 3, namely the guiding bush 12, the supporting pipe 18, and the lead pipe 14. The grooves 20.1 and 20.2 as well as the recess 24 extend from an opening 28.1 in the gripping part 20.1 and an equal diameter 28.2 in the shaft 1.

For advancing a lead 29 from the lead pipe 14 through the writing pipe 4, the writing instrument is held with its tip downwardly and the push button 5 is pressed. As long as the abutment cone 17 acts against the clamping chuck 6, the clamping chuck 6 together with the clamping sleeve 7 moves toward the tip 3 until the clamping sleeve 7 meets the abutment 27. During the further movement of the clamping chuck 6 it opens and the lead 29 can fall out to the lead brake 13. During repeated pressing aginst the push button the lead 29 is advanced through the lead brake 13 out of the writing pipe 4 in steps. When the advanced lead 29 is subjected to a writing pressure, the lead 29 is biased in the closed clamping chuck 6 against the action of the supporting spring 25 rearwardly until it is flush with the writing pipe 4.

If a back springing of the lead 29 in the writing pipe 4 must be prevented the gripping part 2 is to be turned relative to the shaft 1 by an angle which is permitted by the recess 24. As can be seen from FIG. 2, in this position the strip 19.1 does not enter the groove 20.1. The total clamping device can therefore be seen as rigidly connected with the gripping part 2. During pressing against the projecting lead 29 it is fixedly held in the writing instrument.

It will be understood that each of the elements described above, or two or more together, may also find a useful application in other types of constructions differing from the types described above.

While the invention has been illustrated and described as embodied in a refill lead writing instrument, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A refill lead writing instrument for stepped advancement of a lead, comprising a spring biased clamping device for holding a lead in direction of its longitudinal axis against a writing pressure, said clamping device including a clamping chuck supported in a clamping sleeve under a spring action and a longitudinally displaceable lead pipe against which said clamping chuck can abut; a shaft; a gripping part which is formlockingly connected with said shaft so that said shaft and said gripping part are rotatable relative to one another about a common longitudinal axis, said shaft and said gripping part having openings of same diameters and provided with grooves; a longitudinally displaceable supporting pipe having strips guiding in said grooves, one of said grooves having an extension extending in direction of a writing pipe and formed as a recess from which said one strip is turnable out so that when said one strip is turned so as to enter said recess a back springing of the lead in said writing pipe is blocked and when said one strip is turned out of said recess a back springing of said in said writing pipe is allowed and said clamping device operates as rigidly connected with said gripping part.

2. A refill lead writing instrument as defined in claim 1, wherein said supporting pipe is supported on said lead pipe rotatably and longitudinally displaceably, said clamping device having a guiding bush, said shaft having a shoulder, said lead pipe having an abutment ring abutting against said shoulder of said shaft, said supporting pipe being clamped between the guiding bush of said clamping device and said abutment ring of said lead pipe.

3. A refill lead writing instrument as defined in claim 1, wherein said supporting pipe has two such strips which have identical lengths and identical cross-sections, said strips extending on an outer periphery parallel to a longitudinal central axis of said supporting pipe.

4. A refill lead writing instrument as defined in claim 1, wherein said recess is formed as an extended portion of said groove in said gripping part and corresponds to a length of said one strip and is at least double the width of said one groove.

5. A refill lead writing instrument as defined in claim 1, wherein said clamping chuck having a clamping opening and an opposite end; and further comprising a guiding bush and a clamping spring, said clamping chuck with said clamping spring being supported in said guiding bush, said opposite end of said clamping chuck and said lead pipe being arranged at a distance from one another.

6. A refill lead writing instrument as defined in claim 5; and further comprising a tip connected with said gripping part, wherein said distance between said opposite end of said clamping chuck and said lead pipe being at least equal to a distance between a front end of said clamping sleeve to an abutment and to said tip.

7. A refill lead writing instrument as defined in claim 5; and further comprising a tip connected with said gripping part, wherein said distance between said opposite end of said clamping chuck and said lead pipe being at least greater than a distance between a front end of said clamping sleeve to an abutment and to said tip.

8. A refill lead writing instrument as defined in claim 1; and further comprising a shaft and a gripping part, said shaft being provided with a radial groove, said gripping part being provided at its end with several arresting fingers engaging in said radial groove.

* * * * *